US005894687A

United States Patent [19]

Lin

[11] Patent Number: 5,894,687

[45] Date of Patent: Apr. 20, 1999

[54] SHOE PAD HAVING MASSAGING EFFECT

[75] Inventor: Ghing-Yi Lin, Taichung Hsien, Taiwan

[73] Assignee: Gnan-Jang Plastics Co., Ltd., Taichung Hsien, Taiwan

[21] Appl. No.: 08/877,795

[22] Filed: Jun. 18, 1997

[51] Int. Cl.[6] ..... A43B 7/14; A43B 13/40; A43B 13/20; A61F 5/34

[52] U.S. Cl. ..... 36/141; 36/145; 36/153; 36/28; 36/29; 36/43

[58] Field of Search ..... 36/141, 145, 153, 36/28, 29, 43, 44, 11.5

[56] References Cited

U.S. PATENT DOCUMENTS

| | | | |
|---|---|---|---|
| 2,080,469 | 5/1937 | Gilbert | 36/29 |
| 2,589,037 | 6/1952 | Gallagher | 36/44 |
| 2,645,865 | 7/1953 | Town | 36/28 |
| 2,933,835 | 4/1960 | Aronoff | 36/145 |
| 4,458,430 | 7/1984 | Peterson | 36/28 |
| 4,999,931 | 3/1991 | Vermeulen | 36/29 |

FOREIGN PATENT DOCUMENTS

| | | | |
|---|---|---|---|
| 62622 | 10/1982 | European Pat. Off. | 36/29 |
| 335060 | 10/1989 | European Pat. Off. | 36/43 |
| 2102669 | 2/1983 | United Kingdom | 36/43 |
| 91/16831 | 11/1991 | WIPO | 36/29 |
| 93/12685 | 7/1993 | WIPO | 36/29 |
| 93/18677 | 9/1993 | WIPO | 36/28 |

*Primary Examiner*—Paul T. Sewell
*Assistant Examiner*—Anthony Stashick
*Attorney, Agent, or Firm*—Bacon & Thomas, PLLC

[57] ABSTRACT

A shoe pad having massaging effect of the type which is made from resilient and soft plastic material is provided. The shoe pad includes a lower layer and an upper layer. The upper layer is provided with a plurality of bulbs which are evenly distributed over the upper surface of the upper layer. The upper layer further includes a first cell corresponding to the sole of the foot and a second cell corresponding to the heel of the foot. The first and second cells are connected by a connecting passage such that a fluid communication therebetween is established. The upper layer further includes a bulged portion corresponding to the plantar arch of the foot. The lower layer is provided with a planar configuration and is provided with a first and second recesses corresponding to the first and second cells of the upper layer. Wherein when the upper layer is attached to the lower layer, the bulbs can be filled with air and a receiving space can be defined between the cells and the recesses. Wherein the cells can be injected and filled with fluid such that a pressure transferring device is configured. By the provision of the shoe pad, the reactive force toward to the entire foot can be well tenderized. In light of this, the functions of shock-absorbing and fitness can be attained. On the other hand, the reactive force applied to the sole and the heel can be well buffered. A comfort and fitness can therefore be attained.

2 Claims, 4 Drawing Sheets

SHOE PAD HAVING MASSAGING EFFECT

FILED OF THE INVENTION

The present invention relates to a shoe pad, more particularly, to a shoe pad having a plurality of bulbs distributed over the entire surface of the shoe pad. The shoe pad further includes at least two air cells which are disposed apart from each other and while are in fluid communication with each other. By this arrangement, the bottom surface of the foot can be well massaged.

DESCRIPTION OF PRIOR ART

Shoes are an indispensable article for our daily lives. Although there are a plurality of shapes, styles or fashions, the most important factor in selecting a suitable shoes is the fitness and comfort. When correct shoes are selected, not only will the feet be protected, but also will enhance the health of the user. On the other hand, each shoe is incorporated with a shoe pad which is directly in contact with the foot of the user, consequently, the fitness and comfort are directly effected by the shoe pad. As a result, how to increase the cushion effect has become a key benchmark for the development for shoe pad since it may protect the feet as well as massage the feet.

SUMMARY OF THE INVENTION

It is the objective of this invention to provide a shoe pad having massaging effect. By the provision of the shoe pad, the feet can be thorough massaged as well as buffered from shock. Besides, the fitness and comfort of the shoes can be also improved. On the other hand, during walking, running, and jumping, the resulted shock or vibration can be suitable softened and absorbed. Consequently, the reactive force applied to heel and traverse arch can be therefore reduced.

According to one aspect of the present invention, the shoe pad can be integrally combined with the middle sole of the shoe or it can be made into an individual element and inserted into the shoe at the time the shoe is put on.

In order to achieve the objective set forth, the shoe pad having massaging effect includes a substrate having a plurality of projected bulbs which are filled with air even distributed over the entire surface. In light of this, those evenly distributed bulbs provide a soft and effective massaging effect. The substrate further includes a pair of air cells which are located respectively in front and rear portion of the substrate and are in fluid communication with each other. One of the cells is disposed right under the sole of the foot while the other cell is disposed under the heel of the foot. When one of the cells is depressed, the fluid contained therein will be forced to flow toward and the other cell will be expanded. In light of this, the foot portion which exerts force can be well supported. The substrate further includes a bulged portion corresponding to the plantar arch of the foot. As a result, the plantar arch can be fully supported by the bulged portion. The shoe pad made according to the present invention can be incorporated with foot massaging, softening reactive force, absorbing shock and enhanced fitness.

DETAILED DESCRIPTION OF PREFERRED EMBODIMENT

Figure 1:
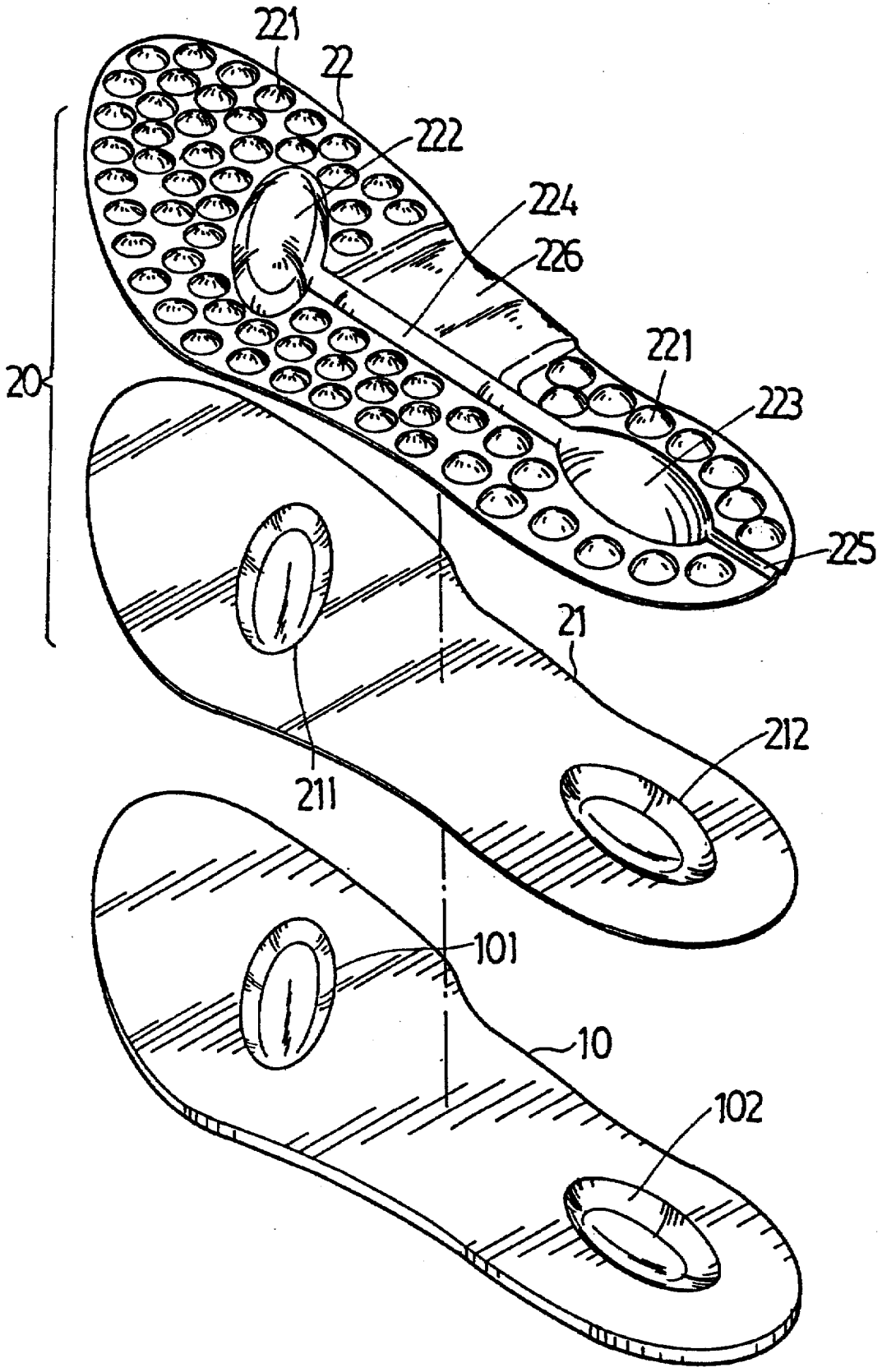
FIG. 1 is an exploded perspective view of the shoe pad made according to the present invention.
Figure 2:
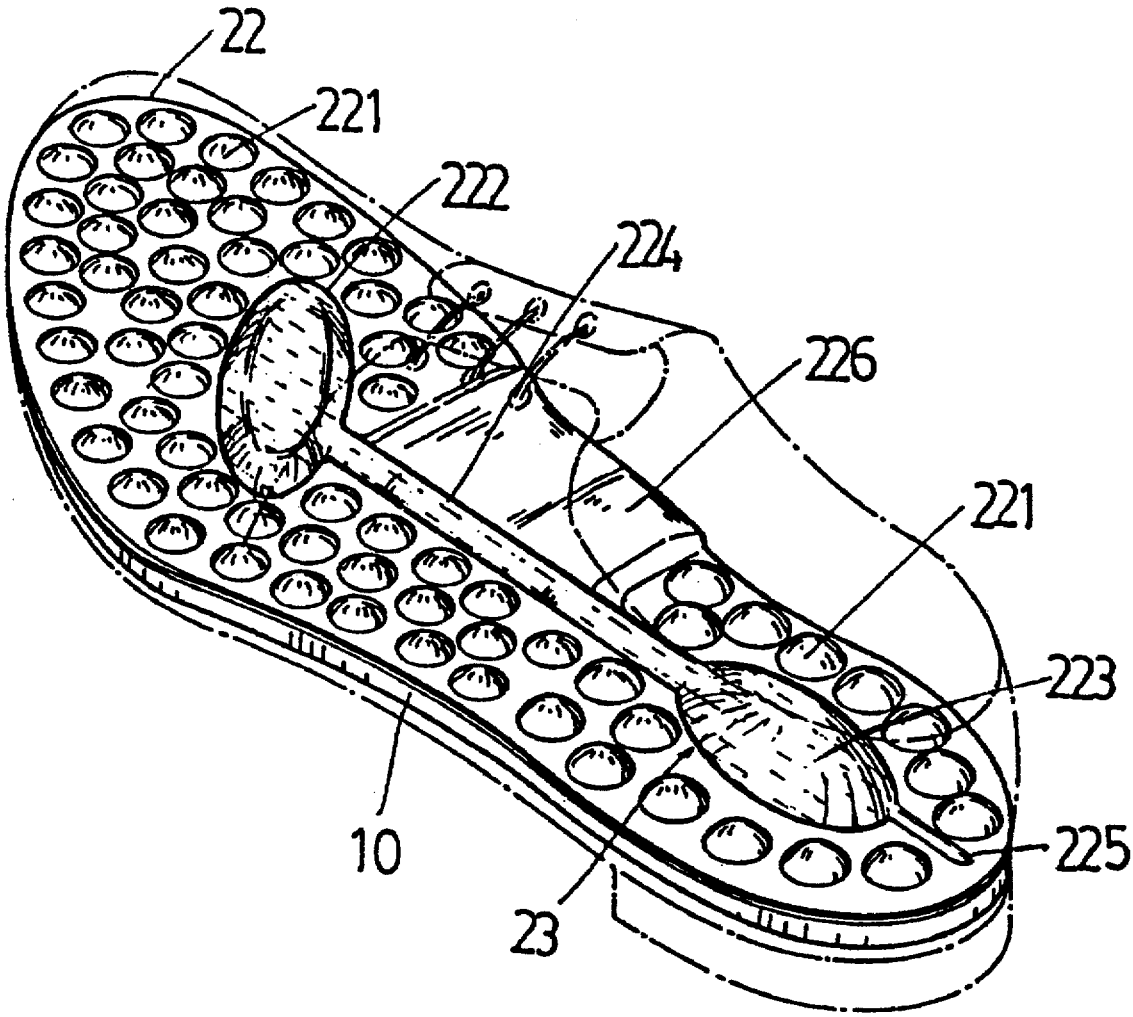
FIG. 2 is a perspective view of the shoe pad made according to the present invention.
Figure 3:
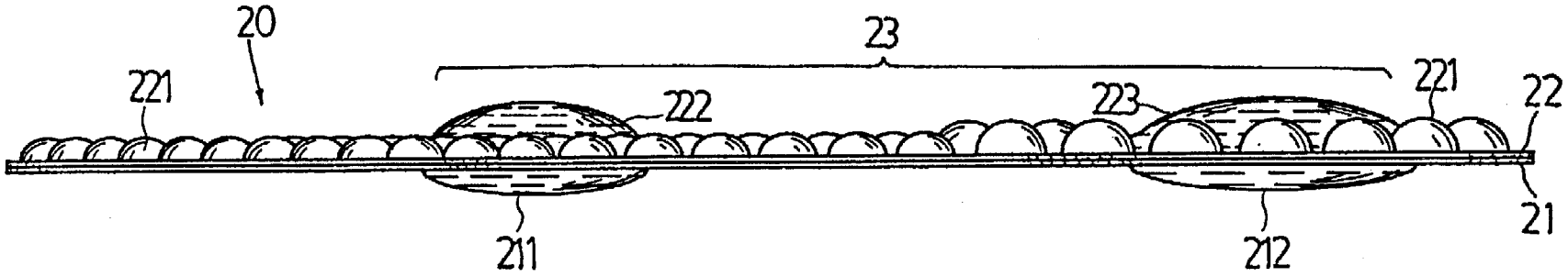
FIG. 3 is a side elevational view of the shoe pad.
Figure 4:
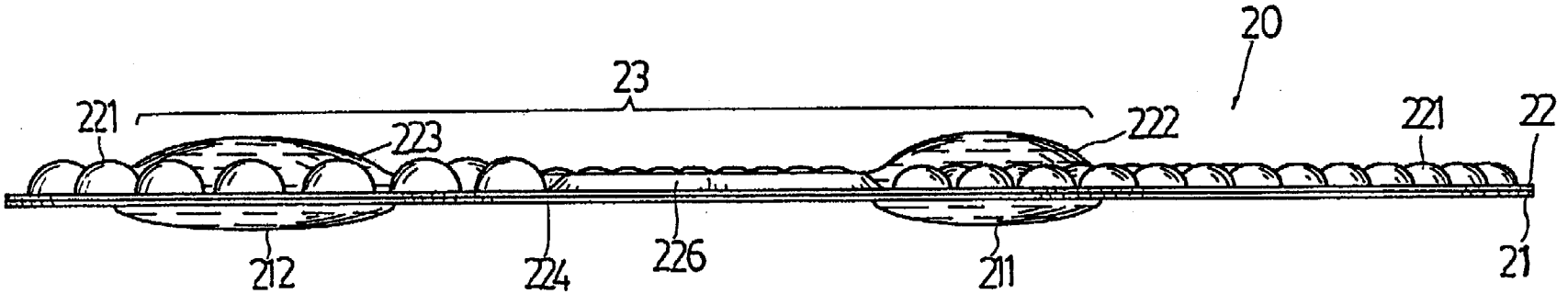
FIG. 4 is another side elevational view of the shoe pad.
Figure 5:
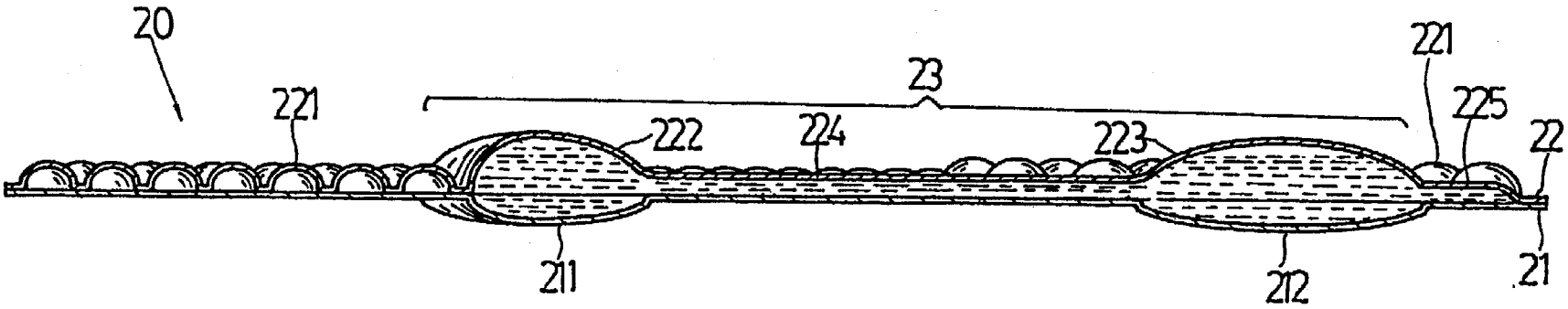
FIG. 5 is a cross sectional view of FIG. 3.

Referring to Figures, the shoe pad having a massaging effect generally comprises a middle sole 10 and a substrate 20 disposed thereon.

The substrate 20 is preferably made from soft and resilient plastic material and includes an bottom layer 21 and an upper layer 22. The thickness of both the bottom and upper layers 21, 22 is about 1 millimeter and in total, substrate 20 has a thickness of 2 millimeters.

The upper layer 22 is provided with a plurality of bulbs 221 evenly distributed over the entire surface of the upper layer 22 via a heat treating process. Generally, the bulbs 221 distributed in one area may have a different diameter and height from those of an other area. For example, the bulbs 221 in the front portion of substrate 20 have a small diameter as well as height as compared with those in rear portion. According to one embodiment, the diameter and height in the front and middle area are about 10.05 millimeters and 4 millimeters respectively and the bulbs 221 in the rear portion have a diameter of 10.25 millimeters and a height of 6 millimeters.

The upper layer 22 includes a first cell 222 which is inclined to the longitudinal direction of the substrate 20 and is disposed in the front portion. The upper layer 22 further includes a second cell 223 which is parallel to the longitudinal direction of the substrate 20 and is disposed in the rear portion. The first and second cells 222 and 223 are connected by a connecting passage 224 disposed therebetween and a fluid communication is established between the first and second cells 222 and 223. An additional connecting passage 225 is disposed to the rear portion of the second cell 223. The upper layer 22 is provided with a bulged portion 226 corresponding to the plantar arch of the foot of the user. The thickness of the bulged portion 226 is equal to the connecting passage 224.

The lower layer 21 has a planar configuration and is provided with a first and second recesses 211 and 212 corresponding to those first and second cells 221 and 222 of the upper layer 22 respectively.

When the upper layer 22 is attached to the lower layer 21, each of the bulbs 221 is sealed and filled with air. On the other hand, the first and second cells 222 and 223 of the upper layer 22 are juxtaposed with the first and second recesses 211 and 212 of the lower layer 21 such that a receiving space is defined between the cells 221, 222 and the recesses 211, 212 respectively. Then a fluid can be injected into those two cells 221 and 222 from the additional connecting passage 225 and the connecting passage 224. After the injection is completed, the additional connecting passage 225 can be sealed and a pressure transferring device 23 is configured and at last the substrate 20 of the shoe pad is completed.

The middle sole 10 is also provided with a first and second limiting recesses 101 and 102 corresponding to the first and second recesses 211, 212 of the lower layer 21 such that the lower layer 21 can be well positioned. Finally, the middle sole 10 can be attached to the substrate 20 to complete the shoe pad.

The shoe pad can be concluded with the following advantages.

The substrate 20 is evenly distributed with bulbs 221 and each of the bulbs 221 is filled with air. By this arrangement, the bottom of the foot can be completely and suitably massaged by the bulbs 221. In light of this, no matter how user stands or walks, those bulbs 221 provide a direct massaging effect to the bottom of the foot. As those bulbs 221 are compressible, an excellent cushion effect is attained. As a result, the skin of the foot will not be injured or scratched due to inadequate cushioning.

Since the skin in the heel area is thicker and insensitive, accordingly, the diameter and height of the bulbs 221 in the rear area are larger and higher then those in the front and middle area. By this arrangement, the heel portion of the foot can also be well and effectively massaged.

When the user stands, the ball portion of the foot is rested on the first cell 222 of the pressure transferring device 23 while the heel portion of the foot is rested on the second cell 223 of the pressure transferring device 23. When the heel touches the ground, the second cell 223 is depressed and the fluid contained thereof will be pumped to the first cell 222 and which will be expanded upward to massage the sole portion. When the ball sole portion touches the ground, the first cell 222 is depressed and the fluid contained therein will be pumped into the second cell 223 to massage the heel portion. By this arrangement, the ball portion and the heel portion of the foot will be alternatively massaged by the expanded first and second cells 222 and 223 during the user walks.

Regarding to the plantar arch, the substrate 20 is provided with a bulged portion 226 and the plantar arch can be well supported.

From the forgoing description, since the substrate 20 is provided with bulbs 221, a pressure transferring device 23, and a bulged portion 226, the overall bottom of the user's foot can be well massaged and buffered. On the other hand, the fitness and comfort can also be well improved. Furthermore, by the provision of the pressure transferring device 23, the reactive force applied to the ball portion and the heel portion can be well buffered. In light of this, the functions of shock-absorbing and fitness can be attained.

While the substrate 20 is integrally attached to the middle sole 10, the substrate 20 can also be made into an individual element and sold separately. Even when the substrate 20 is disposed up side down, i.e. the lower layer 21 faces upward and is in contact with the sole of the foot, the shock-absorbing, buffering effects can still be attained as the pressure transferring device 23 functions as well.

I claim:

1. A shoe pad made from resilient and soft plastic material shaped to produce a massaging effect on a wearer's foot, said shoe pad comprising:

a lower layer and an upper layer;

said upper layer being provided with a plurality of bulbs which are evenly distributed over the upper surface of said upper layer, said upper layer further including a first cell corresponding to the ball of said foot and a second cell corresponding to the heel of said foot, said first and second cells being connected by a connecting passage such that a fluid communication therebetween is established, said upper layer further including a bulged portion corresponding to the plantar arch of the foot;

said first and second cells being arranged to directly contact the wearer's foot so as to produce a massaging effect;

said first and second cells each having a longitudinal axis along its length direction arranged in oblique and aligned directions relative to a front-to-rear axis of the shoe pad, respectively; and said lower layer being provided with a planar configuration and being provided with first and second recesses corresponding to said first and second cells of said upper layer; wherein said upper layer is attached to said lower layer, said bulbs are filled with air and a receiving space is defined between said cells and said recesses, wherein said cells are injected and filled with fluid to provide a pressure transferring device.

2. A shoe pad having a massaging effect as recited in claim 1, wherein the height of said bulged portion is equal to the height of said connecting passage of said pressure transferring device.

* * * * *